US007254215B2

(12) United States Patent
Ross et al.

(10) Patent No.: US 7,254,215 B2
(45) Date of Patent: Aug. 7, 2007

(54) SYSTEMS AND METHODS FOR REDUCING RADIATION DOSAGE

(75) Inventors: Steven Gerard Ross, Waukesha, WI (US); Thomas Louis Toth, Brookfield, WI (US); Willi Walter Hampel, Hartland, WI (US); Bruce Matthew Dunham, Mequon, WI (US)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 69 days.

(21) Appl. No.: 10/695,211

(22) Filed: Oct. 28, 2003

(65) Prior Publication Data

US 2005/0089145 A1 Apr. 28, 2005

(51) Int. Cl.
*G21K 1/04* (2006.01)

(52) U.S. Cl. ..... 378/150; 378/16; 378/147; 378/152

(58) Field of Classification Search ..... 378/5, 378/16, 19, 145–155, 65, 98.8; 250/363.1, 250/370.09, 505.1
See application file for complete search history.

(56) References Cited

U.S. PATENT DOCUMENTS 4,190,773 A * 2/1980 Braden et al. ..... 378/10
5,317,616 A * 5/1994 Swerdloff et al. ..... 378/65
5,418,833 A * 5/1995 Logan ..... 378/154
5,644,614 A 7/1997 Toth et al.
5,668,851 A * 9/1997 Dobbs ..... 378/19
5,799,057 A * 8/1998 Hoffman et al. ..... 378/147
5,801,939 A * 9/1998 Okazaki ..... 700/56
6,056,437 A 5/2000 Toth
6,141,402 A 10/2000 Toth
6,252,927 B1 * 6/2001 Wieczorek et al. ..... 378/19
6,396,902 B2 * 5/2002 Tybinkowski et al. ..... 378/150
6,501,828 B1 * 12/2002 Popescu ..... 378/150
6,587,538 B2 * 7/2003 Igarashi et al. ..... 378/19
6,618,467 B1 * 9/2003 Ruchala et al. ..... 378/65
6,731,716 B2 * 5/2004 Mihara et al. ..... 378/9
7,170,975 B2 * 1/2007 Distler et al. ..... 378/150
2002/0015474 A1 2/2002 Tybinkowkski et al.
2006/0039527 A1 * 2/2006 Malamud ..... 378/7

* cited by examiner

*Primary Examiner*—Allen C. Ho
(74) *Attorney, Agent, or Firm*—Armstrong Teasdale LLP

(57) ABSTRACT

An imaging system including is described. The imaging system includes a radiation source configured to generate a beam, a collimator configured to collimate the beam to generate a collimated beam, and a detector configured to detect the collimated beam. The collimator is one of a first collimator with a curved contour proportional to a contour of the detector, a second collimator with blades, where slopes of two oppositely-facing surfaces of at least one of the blades are different from each other, and a third collimator having at least two sets of plates, where the plates in a set pivot with respect to each other.

10 Claims, 6 Drawing Sheets

SYSTEMS AND METHODS FOR REDUCING RADIATION DOSAGE

BACKGROUND OF THE INVENTION

This invention relates generally to imaging systems and more particularly to systems and methods for reducing radiation dosage incident on a subject.

A third generation computed tomography (CT) scanner includes an x-ray source and a detector that are rotated together around a patient. An x-ray beam is passed through the patient and intensity of the x-ray beam is measured on the detector. In some CT imaging systems, an x-ray tube is used to create the x-rays. X-rays are produced when electrons are accelerated against a focal spot or an anode by a high voltage difference between the anode and a cathode of the x-ray tube. These x-rays typically diverge conically from the focal spot, and the diverging x-ray beam is typically passed through a pre-patient collimator to define an x-ray beam profile on the detector. Some CT imaging systems include detector cells arranged on an arc of constant radius from the source. If the collimator is linear, or rectangular, an x-ray beam profile on the detector will become curved along a fan of the detector as an aperture of the collimator is opened along a z-axis. The curvature can result in both unused x-ray dose and degradation in a CT image formed from the curved x-ray beam profile.

BRIEF DESCRIPTION OF THE INVENTION

In one aspect, an imaging system is provided. The imaging system includes a radiation source configured to generate a beam, a collimator configured to collimate the beam to generate a collimated beam, and a detector configured to detect the collimated beam. The collimator is one of a first collimator with a curved contour proportional to a contour of the detector, a second collimator with blades, where slopes of two oppositely-facing surfaces of at least one of the blades are different from each other, and a third collimator having at least two sets of plates, where the plates in a set pivot with respect to each other.

In another aspect, a computed tomography imaging system is provided. The computed tomography imaging system includes an x-ray source configured to generate a beam, a collimator configured to collimate the x-ray beam to generate a collimated x-ray beam, and a detector configured to detect the collimated x-ray beam. The collimator is one of a first collimator with a curved contour proportional to a contour of the detector, a second collimator with blades, where slopes of two oppositely-facing surfaces of at least one of the blades are different from each other, and a third collimator having at least two sets of plates, where the plates in a set pivot with respect to each other.

In yet another aspect, a method for reducing dosage of radiation incident on a subject is provided. The method includes transmitting a beam of radiation toward the subject, collimating the beam of radiation before the beam reaches the subject, and detecting the collimated beam of radiation. The collimating is performed by one of a first collimator with a curved contour proportional to a contour of a detector that detects the collimated beam, a second collimator with blades, where slopes of two oppositely-facing surfaces of at least one of the blades are different from each other, and a third collimator having at least two sets of plates, where the plates in a set pivot with respect to each other.

DETAILED DESCRIPTION OF THE INVENTION

Figure 1:
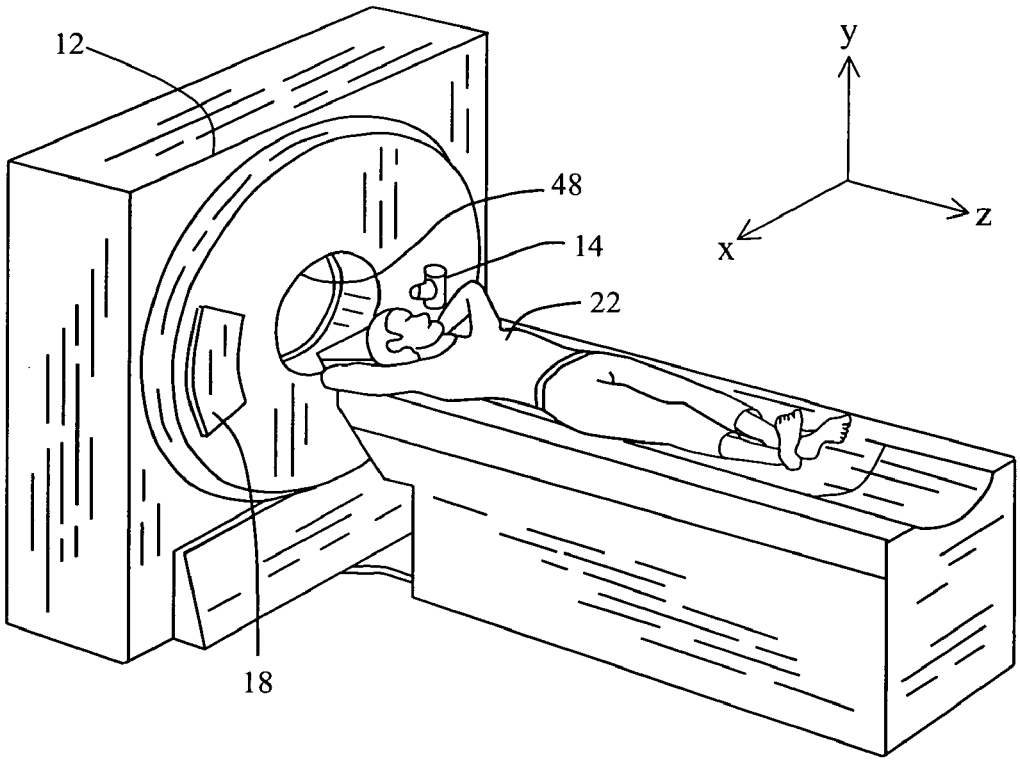
FIG. 1 is a perspective view of an embodiment of a computed tomography (CT) imaging system in which systems and methods for reducing radiation dosage are implemented.

In some known CT imaging system configurations, an x-ray source projects a fan-shaped beam which is collimated to lie within an X-Y plane of a Cartesian coordinate system and generally referred to as an "imaging plane". The x-ray beam passes through an object, such as a patient, being imaged. The beam, after being attenuated by the object, impinges upon an array of radiation detectors. The intensity of the attenuated radiation beam received at the detector array is dependent upon the attenuation of an x-ray beam by the object. Each detector element of the array produces a separate electrical signal that is a measurement of the beam attenuation at the detector location. The attenuation measurements from all the detectors are acquired separately to produce a transmission profile.

In third generation CT imaging systems, the x-ray source and the detector array are rotated with a gantry within the imaging plane and around the object to be imaged such that the angle at which the x-ray beam intersects the object constantly changes. A group of x-ray attenuation measurements, i.e., projection data, from the detector array at one gantry angle is referred to as a "view". A "scan" of the object comprises a set of views made at different gantry angles, or view angles, during one revolution of the x-ray source and detector.

In an axial scan, the projection data is processed to construct an image that corresponds to a two dimensional slice taken through the object. One method for reconstructing an image from a set of projection data is referred to in the art as the filtered back projection technique. This process converts the attenuation measurements from a scan into integers called "CT numbers" or "Hounsfield units", which are used to control the brightness of a corresponding pixel on a cathode ray tube display.

To reduce the total scan time, a "helical" scan may be performed. To perform a "helical" scan, the object is moved while the data for the prescribed number of slices is acquired. Such a system generates a single helix from a one fan beam helical scan. The helix mapped out by the fan beam yields projection data from which images in each prescribed slice may be reconstructed.

Reconstruction algorithms for helical scanning typically use helical weighing algorithms that weight the collected data as a function of view angle and detector channel index. Specifically, prior to a filtered backprojection process, the data is weighted according to a helical weighing factor, which is a function of both the gantry angle and detector angle. The helical weighting algorithms also scale the data according to a scaling factor, which is a function of the distance between the x-ray source and the object. The weighted and scaled data is then processed to generate CT numbers and to construct an image that corresponds to a two dimensional slice taken through the object.

As used herein, an element or step recited in the singular and preceded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

Also as used herein, the phrase "reconstructing an image" is not intended to exclude embodiments of the present invention in which data representing an image is generated but a viewable image is not. However, many embodiments generate (or are configured to generate) at least one viewable image.

Figure 2:
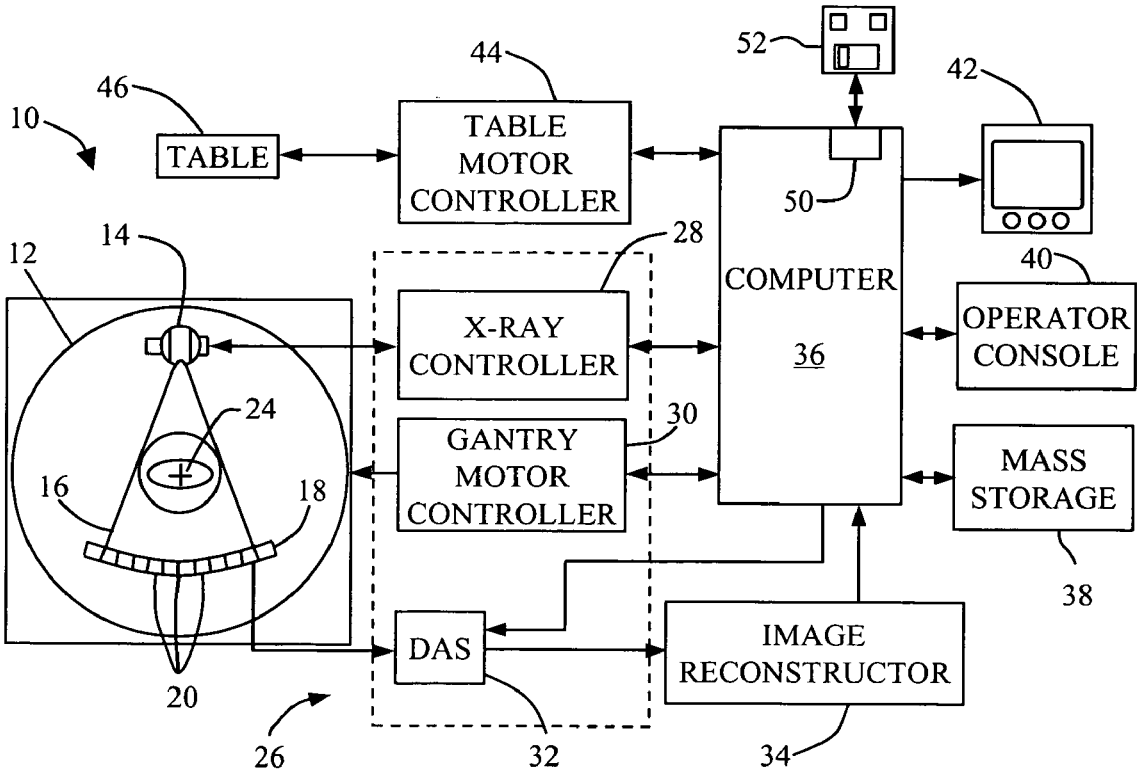
FIG. 2 is a block diagram of the CT imaging system of FIG. 1.

Referring to FIGS. 1 and 2, a multi-slice scanning imaging system, for example, a computed tomography (CT) imaging system 10, is shown as including a gantry 12 representative of a "third generation" CT imaging system. Gantry 12 has an x-ray source 14 that projects a beam of x-rays 16 toward a detector array 18 on the opposite side of gantry 12. Detector array 18 is formed by a plurality of detector rows (not shown) including a plurality of detector elements or cells 20 which together sense the projected x-rays that pass through an object 22, such as a medical patient. As an example, width of each detector element 20 along a z-axis is greater than 40 millimeters (mm) as scaled to an isocenter of x-ray beam 16. Each detector element 20 produces an electrical signal that represents the intensity of an impinging x-ray and hence the attenuation of the x-ray as it passes through object 22. During a scan to acquire x-ray projection data, gantry 12 and the components mounted thereon rotate about a center of rotation 24. FIG. 2 shows only a single row of detector elements 20 (i.e., a detector row). However, multislice detector array 18 includes a plurality of parallel detector rows of detector elements 20 such that projection data corresponding to a plurality of quasi-parallel or parallel slices can be acquired simultaneously during a scan.

Rotation of gantry 12 and the operation of x-ray source 14 are governed by a control mechanism 26 of CT imaging system 10. Control mechanism 26 includes an x-ray controller 28 that provides power and timing signals to x-ray source 14 and a gantry motor controller 30 that controls the rotational speed and position of gantry 12. A data acquisition system (DAS) 32 in control mechanism 26 samples analog data from detector elements 20 and converts the data to digital signals for subsequent processing. An image reconstructor 34 receives sampled and digitized x-ray data from DAS 32 and performs high-speed image reconstruction. The reconstructed image is applied as an input to a computer 36 which stores the image in a mass storage device 38.

Computer 36 also receives commands and scanning parameters from an operator via console 40 that has a keyboard. An associated cathode ray tube display 42 allows the operator to observe the reconstructed image and other data from computer 36. The operator supplied commands and parameters are used by computer 36 to provide control signals and information to DAS 32, x-ray controller 28 and gantry motor controller 30. In addition, computer 36 operates a table motor controller 44 which controls a motorized table 46 to position object 22 in gantry 12. Particularly, table 46 moves portions of object 22 through gantry opening 48.

In one embodiment, computer 36 includes a device 50, for example, a floppy disk drive, CD-ROM drive, DVD drive, magnetic optical disk (MOD) device, or any other digital device including a network connecting device such as an Ethernet device for reading instructions and/or data from a computer-readable medium 52, such as a floppy disk, a CD-ROM, a DVD or an other digital source such as a network or the Internet, as well as yet to be developed digital means. In another embodiment, computer 36 executes instructions stored in firmware (not shown). Computer 36 is programmed to perform functions described herein, and as used herein, the term computer is not limited to just those integrated circuits referred to in the art as computers, but broadly refers to computers, processors, microcontrollers, microcomputers, programmable logic controllers, application specific integrated circuits, and other programmable circuits, and these terms are used interchangeably herein.

Figure 3:
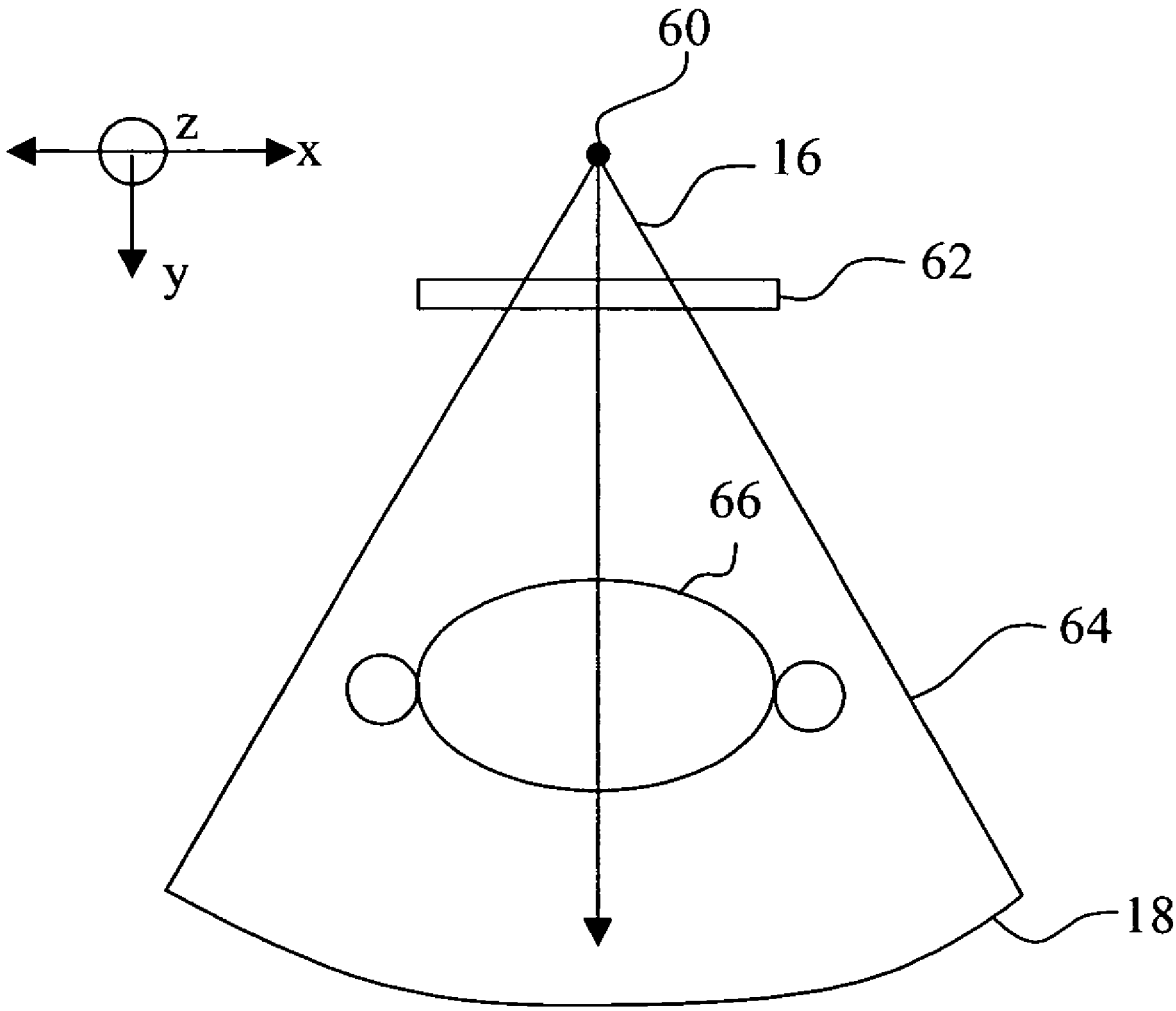
FIG. 3 is a diagram of an embodiment of a collimator and a portion of the CT imaging system.

FIG. 3 is a diagram of an embodiment of a pre-patient collimator 62 and a portion of gantry 12 of CT imaging system 10. X-ray beam 16 emanates from a focal point 60 at which x-ray source 14 is located. X-ray beam 16 is collimated by collimator 62, and a collimated fan beam 64 is projected via an object 66 toward detector array 18 along a fan beam axis centered within collimated beam 64. Detector array 18 is curved at a fixed radius from focal point 60.

Figure 4:
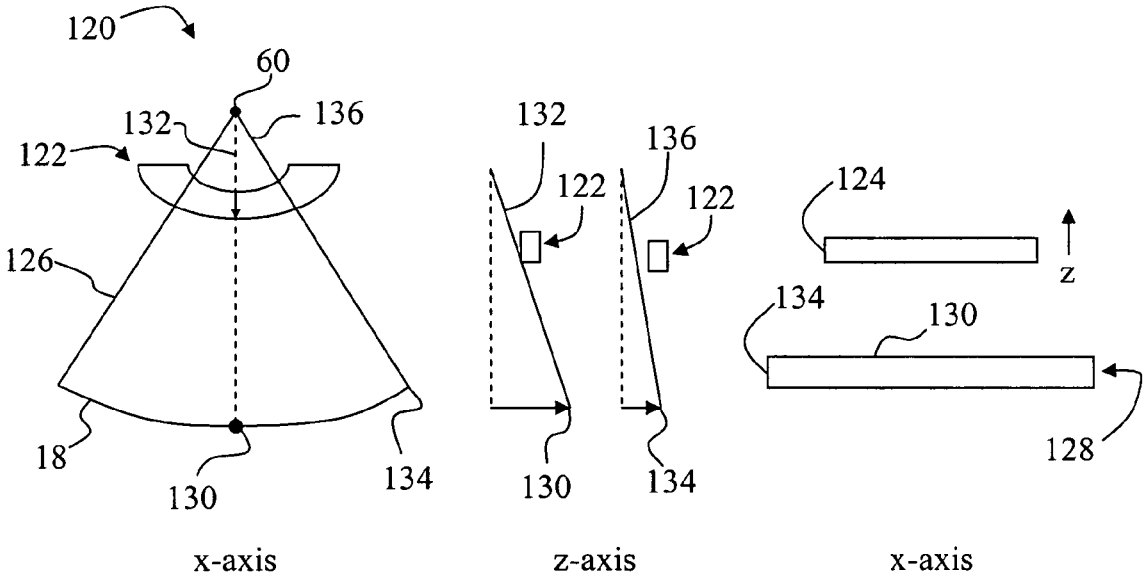
FIG. 4 is a diagram showing an embodiment of a system for reducing radiation dosage and showing effects of the system.
Figure 5:
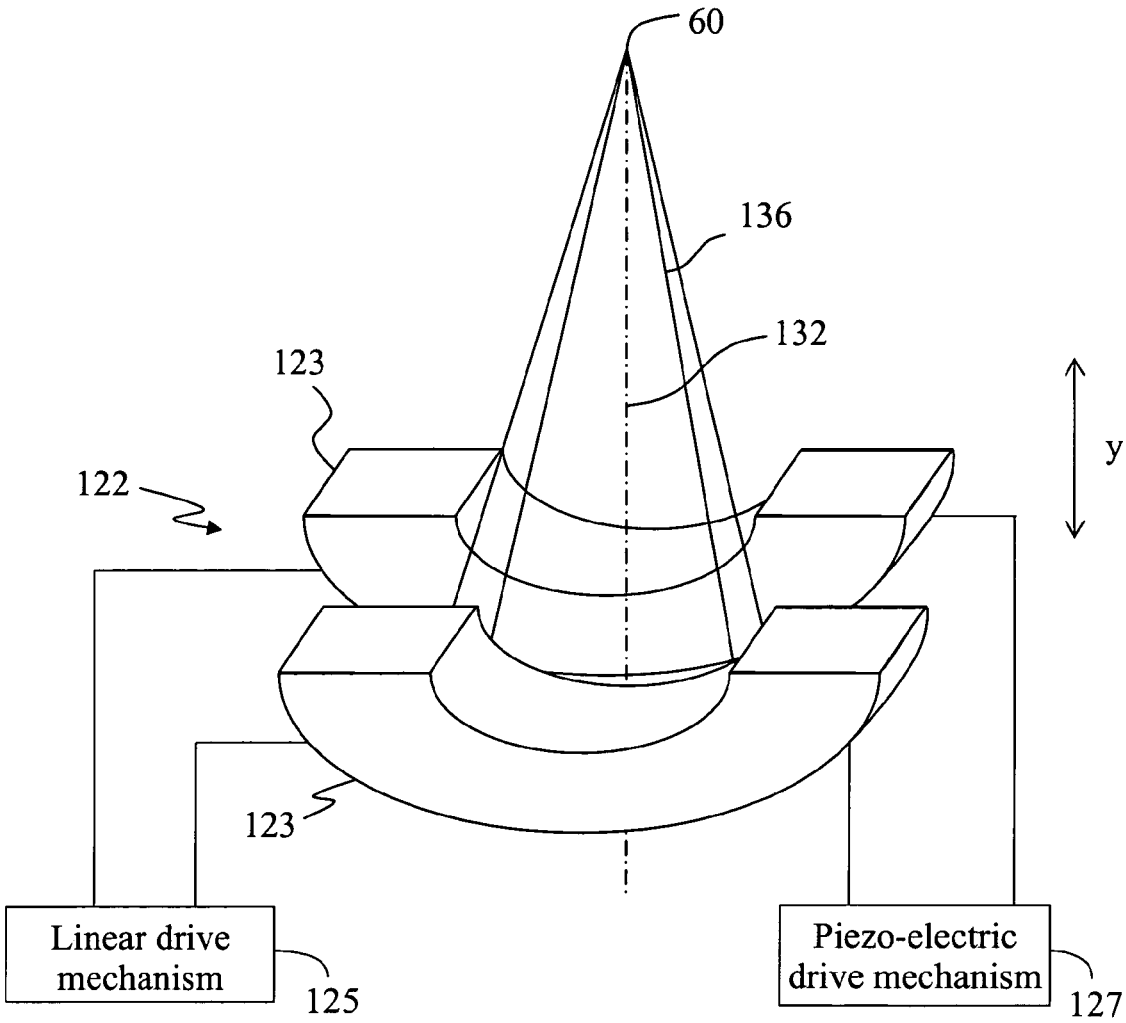
FIG. 5 is an isometric view of an embodiment of a collimator included within the system of FIG. 4.

FIG. 4 shows an embodiment of a system 120 for reducing radiation dosage. System 120 includes x-ray source 14 at a focal point 60, a collimator 122, and detector array 18. An isometric view of an embodiment of collimator 122 is shown in FIG. 5. Collimator 122 is contoured in a direction along a y-axis. Collimator 122 includes a plurality of cams 123 that are driven linearly along the z-axis to produce apertures of various sizes, such as widths. Referring back to FIG. 4, aperture 124 is an example of an aperture formed by the cams 123 of collimator 122. Prior to scanning, the cams 123 are driven to a pre-set position by a linear drive mechanism 125 (FIG. 5), such as a screw, to form a pre-set aperture between the cams. To change a size of the pre-set aperture during a scan, a piezo-electric drive mechanism 127 (FIG. 5) is used to position the cams 123.

X-ray source 14 transmits x-ray beam 16 towards collimator 122. Collimator 122 collimates or restricts x-ray beam 16 to generate a collimated beam 126. Collimated beam 126 falls on detector elements 20 and generates an x-ray beam profile 128. X-ray beam profile 128 is a projection of collimated beam 126. Curvature of x-ray beam profile 128 is minimal for all sizes, such as widths, of apertures formed by the cams 123 of collimator 122.

A radius of curvature of collimator 122 is proportional to a radius of curvature of detector array 18. As an example, a radius of curvature of detector array 18 at a point 130 is x+y centimeters (cm), where x is a radius of curvature of collimator 122 at a distance 132 from focal point 60, and where x and y are real numbers greater than zero. In this example, a radius of curvature of detector array 18 at a point 134 is m+y cm, where m is a radius of curvature of collimator 122 at a distance 136 from focal point 60, and where m is a real number greater than zero. A radius of curvature of collimator 122 and detector array 18 is measured from focal point 60. Distance 132 is approximately equal to distance 136 because a contour of collimator 122 matches a contour of detector array 18.

Figure 6:
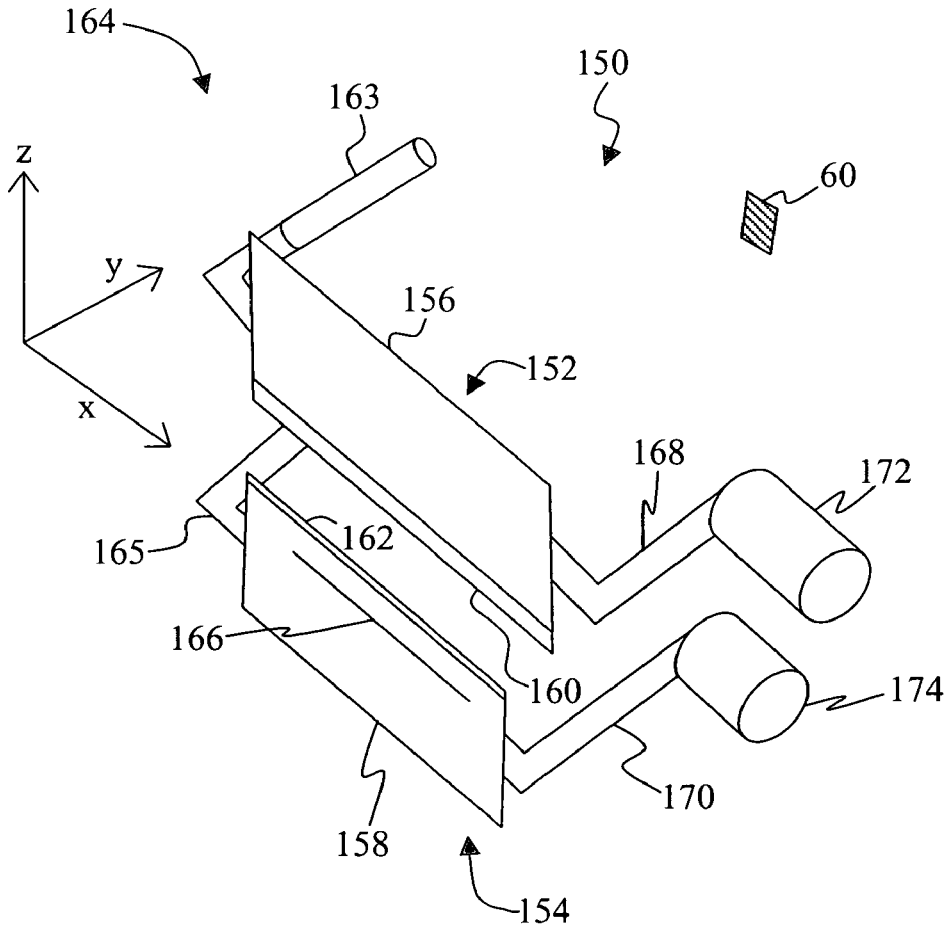
FIG. 6 is a diagram of an embodiment of a collimator that is used in the CT imaging system of FIG. 1.
Figure 6:
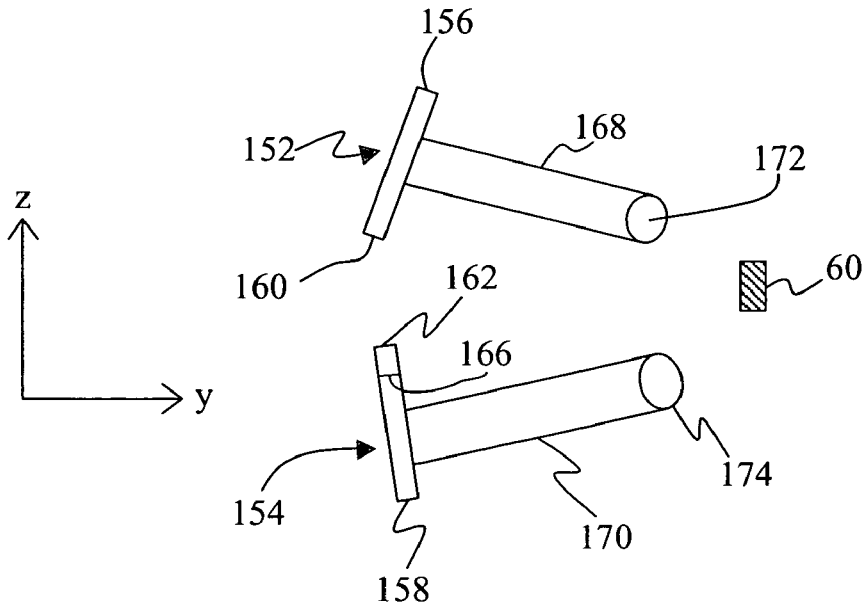

FIG. 6 shows an embodiment of a collimator 150 that is used in systems and methods for radiation dosage. Collimator 150 includes blades or plates 152 and 154. Blades 152 and 154 can be of shapes such as square, rectangular, polygonal, circular, and oval. Each blade 152 and 154 has a respective outer surface 156 and 158 and a respective inner surface 160 and 162. Inner surface 160 of blade 152 has different taper or slope than outer surface 156 and inner surface 162 of blade 154 has a different taper than outer surface 158. In an alternative embodiment, any one of surfaces 156, 158, 160, and 162 has a different taper than remaining surfaces. Blades 152 and 154 may be of the same or different sizes. A pivot arm 163 supports blade 152 and a pivot arm 165 supports blade 154.

Blades 152 and 154 are partially closed but do not overlap each other, as shown in an isometric view 164, to form an aperture with a large width between inner surfaces 160 and 162 of blades 152 and 154. An example of an aperture with a large width is an aperture whose x-ray beam profile has a width greater than 30 mm on detector array 18. When blades 152 and 154 are partially closed to obtain the aperture with the large width, distance between outer surfaces 156 and 158 is greater than distance between inner surfaces 160 and 162. Tapers of inner surfaces 160 and 162 can be optimized for apertures of large widths.

Alternatively, blades 152 and 154 are partially closed but do not overlap each other to form an aperture with a medium width between outer surfaces 156 and 158 of the blades. If blades 152 and 154 are in a position shown in isometric view 164, the blades are overlapped with each other and cross-over each other so that an aperture with a medium width is formed between outer surfaces 156 and 158 of the blades. An example of an aperture with a medium width is an aperture whose x-ray beam profile has a width from 1 mm to 30 mm on detector array 18. When blades 152 and 154 are partially closed to obtain the aperture with the medium width, distance between inner surfaces 160 and 162 is greater than distance between outer surfaces 156 and 158. Tapers of outer surfaces 156 and 158 can be optimized for apertures of medium widths.

In yet another alternative embodiment, blade 154 includes a slit 166 or an aperture having a small width through which x-ray beam 16 passes to form an x-ray beam profile on detector array 18. An example of an aperture with a small width is an aperture whose x-ray beam profile has a width of approximately 1 mm on detector array 18. Alternatively, blade 152 includes slit 166.

Each blade 152 and 154 is coupled to a respective shaft 168 and 170 that is coupled to a respective motor 172 and 174. Motors 172 and 174 provide rotational motion to blades 152 and 154 so that the blades can overlap and cross-over each other. Alternatively, a linear drive mechanism is used to operate blades 152 and 154. However, motors 172 and 174 have less susceptibility to wear and tear as compared to the linear drive mechanism.

Figure 7:
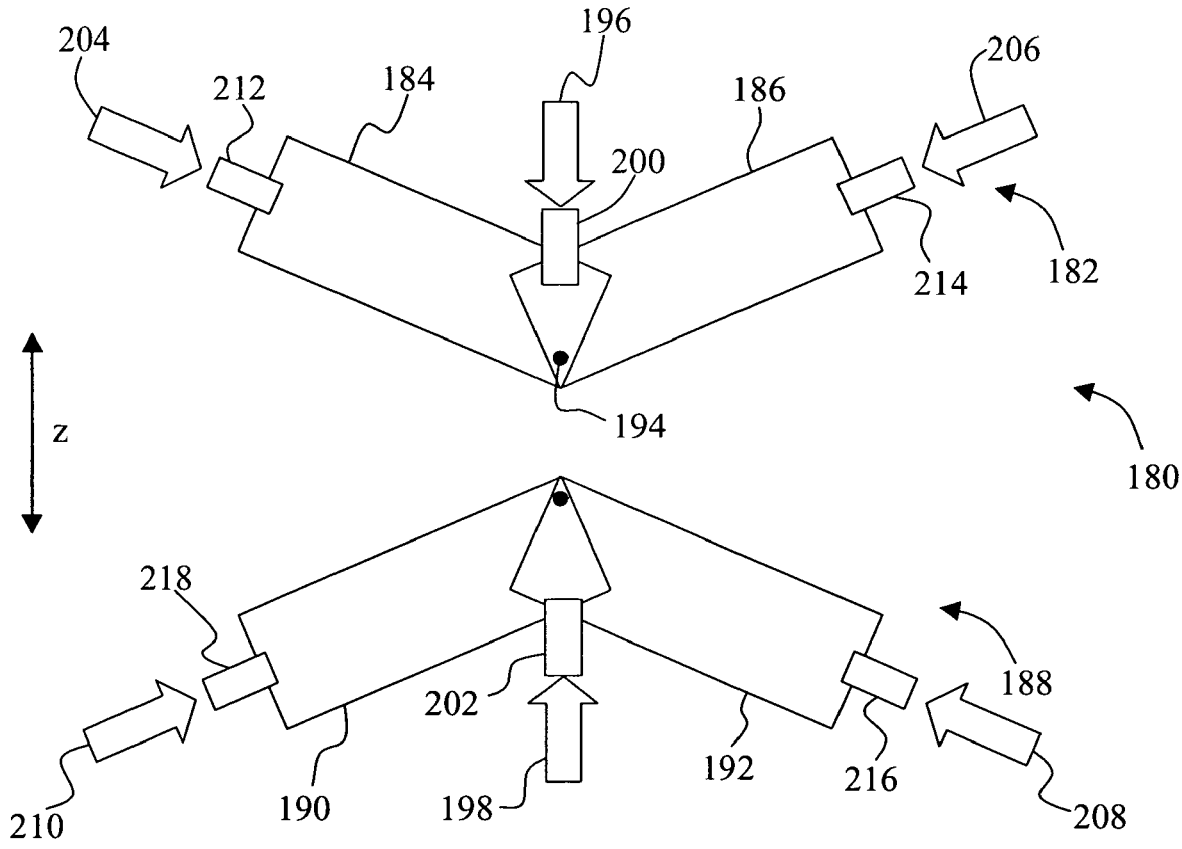
FIG. 7 is a diagram of an embodiment of a collimator that is used in the CT imaging system of FIG. 1.

FIG. 7 shows another alternative embodiment of a collimator 180 that is used in systems and methods for reducing radiation dosage. Collimator 180 includes a first set 182 of plates or blades 184 and 186 and a second set 188 of plates or blades 190 and 192. Plates 184 and 186 can be of shapes such as square, rectangular, polygonal, circular, and oval. Plates 184 and 186 are coupled to each other by a hinge 194 so that plates 184 and 186 move with respect to each other. Plates 190 and 192 are coupled in a similar manner to that of plates 184 and 186. Inner drives, which are shown as arrows 196 and 198, and rectangles 200 and 202, control a nominal width, for instance, a width at ends, of an aperture formed between set 182 and set 188. Outer drives, which are shown as arrows 204, 206, 208, and 210, and rectangles 212, 214, 216, and 218, adjust a taper or a slope, for instance, along the z-axis, of the aperture formed between set 182 and set 188. An optimal x-ray beam profile can be generated on detector array 18 for all nominal apertures formed between set 182 and set 188.

Technical effects of the herein described systems and methods include reducing a curvature of an x-ray beam profile formed on detector array 18 while simultaneously supporting a wide range of apertures. For instance, collimator 150 provides apertures of large, medium, and small widths while simultaneously reducing curvature of x-ray beam profiles. It is noted that although CT imaging system 10 described herein is a "third generation" system in which both the x-ray source 14 and detector array 18 rotate with gantry 12, many other CT imaging systems including "fourth generation" systems where a detector is a full-ring stationary detector and an x-ray source rotates with the gantry, may be used. It is also noted that although a curved detector array is shown in FIGS. 1, 2, 3, 4, and 5, a linear or a straight detector array can be used instead. For instance, collimator 150 collimates x-ray beam 16 to project an x-ray beam profile on the linear detector array. As another instance, collimator 180 collimates x-ray beam 16 to project an x-ray beam profile on the linear detector array.

While the invention has been described in terms of various specific embodiments, those skilled in the art will recognize that the invention can be practiced with modification within the spirit and scope of the claims.

What is claimed is:

1. An imaging system comprising:

a gantry comprising:

a radiation source configured to generate a beam;

a collimator configured to collimate the beam to generate a collimated beam; and a detector configured to detect the collimated beam, wherein the collimator is separate from said detector and comprises at least one radio opaque member having a curved contour proportional to a contour of the detector, wherein said at least one radio opaque member includes a first portion and a second portion spaced a distance from said first portion, wherein said first portion and said second portion are each configured to move along a direction substantially parallel to a rotational axis of said gantry, wherein each of said first portion and said second portion includes a first collimator point at a first collimator distance from said radiation source and a second collimator point at a second collimator distance from said radiation source, wherein said detector includes a first detector point at a first detector distance from the first collimator point and a second detector point at a second detector distance from the second collimator point, and wherein a sum of the first collimator distance and the first detector distance is equal to a sum of the second collimator distance and the second detector distance.

2. An imaging system in accordance with claim 1 wherein said curved contour of said collimator and said contour of said detector are concentric.

3. An imaging system in accordance with claim 1 further comprising:

a linear drive mechanism configured to form an aperture defined by said first portion and said second portion, wherein the aperture has a size; and a piezo-electric drive mechanism configured to change the size of the aperture, wherein said linear drive mechanism is separate from said piezo-electric drive mechanism.

4. An imaging system in accordance with claim 1 wherein said collimator is located between a subject and said radiation source.

5. An imaging system in accordance with claim 1 wherein the at least one radio opaque member comprises at least two cams positionable relative to each other to form a plurality of differently sized apertures.

6. An imaging system in accordance with claim 1 wherein the collimator is configured to move in a direction perpendicular to a plane formed by the beam of the radiation source.

7. A computed tomography imaging system comprising:

a gantry comprising:

an x-ray source configured to generate a beam;

a collimator configured to collimate the beam to generate a collimated x-ray beam; and a detector configured to detect the collimated x-ray beam, wherein the collimator is separate from said detector and comprises at least one radio opaque member having a curved contour proportional to a contour of the detector, wherein said at least one radio opaque member comprises a first portion and a second portion spaced a distance from said first portion, wherein said first portion and said second portion are each configured to move along a direction substantially parallel to a rotational axis of said gantry, wherein each of said first portion and said second portion includes a first collimator point at a first collimator distance from said x-ray source and a second collimator point at a second collimator distance from said x-ray source, wherein said detector includes a first detector point at a first detector distance from the first collimator point and a second detector point at a second detector distance from the second collimator point, and wherein a sum of the first collimator distance and the first detector distance is equal to a sum of the second collimator distance and the second detector distance.

8. A computed tomography imaging system in accordance with claim 7 wherein said curved contour of said collimator and said contour of said detector are concentric.

9. A computed tomography imaging system in accordance with claim 7 further comprising:

a linear drive mechanism configured to form an aperture of said first collimator, wherein said aperture has a size; and a piezo-electric drive mechanism configured to change the size of said aperture defined by said first portion and said second portion, wherein said linear drive mechanism is separate from said piezo-electric drive mechanism.

10. A method for reducing dosage of radiation incident on a subject, said method comprising:

providing a gantry that comprises a radiation source, a collimating device, and a detector;

transmitting, from the radiation source, a beam of radiation toward the subject;

collimating the beam of radiation before the beam reaches the subject; and detecting, by the detector, the collimated beam of radiation, wherein the collimating is performed by the collimating device that is separate from the detector and includes at least one radio opaque member having a curved contour proportional to a contour of the detector that detects the collimated beam, wherein the at least one radio opaque member includes a first portion and a second portion spaced a distance from the first portion, wherein the first portion and the second portion are each configured to move along a direction substantially parallel to a rotational axis of the gantry, wherein each of the first portion and the second portion includes a first collimator point at a first collimator distance from the radiation source and a second collimator point at a second collimator distance from the radiation source, wherein the detector includes a first detector point at a first detector distance from the first collimator point and a second detector point at a second detector distance from the second collimator point, and wherein a sum of the first collimator distance and the first detector distance is equal to a sum of the second collimator distance and the second detector distance.

* * * * *